United States Patent [19]

Arringotn

[11] Patent Number: 4,737,940

[45] Date of Patent: Apr. 12, 1988

[54] TROLLING MOTOR WITH SONAR TRANSDUCER

[75] Inventor: Tracy M. Arringotn, Grapevine, Tex.

[73] Assignee: Pace Manufacturing Company, Arlington, Tex.

[21] Appl. No.: 901,435

[22] Filed: Aug. 28, 1986

Related U.S. Application Data

[63] Continuation-in-part of Ser. No. 613,816, May 25, 1984, Pat. No. Des. 289,019.

[51] Int. Cl.[4] ..... H04R 15/00

[52] U.S. Cl. ..... 367/173; 367/910; 367/106; 181/140; 440/113

[58] Field of Search ..... 367/104, 106, 109, 120, 367/130, 131, 141, 157, 165, 173, 155, 910; 181/139, 140, 142; 310/337; D10/46; 440/2, 113; 114/20–25, 242, 312

[56] References Cited

U.S. PATENT DOCUMENTS

| | | | |
|---|---|---|---|
| 2,757,475 | 8/1956 | Pankove | 367/157 |
| 2,832,944 | 4/1958 | Kessler | 367/173 |
| 3,059,217 | 10/1962 | Boswell | 367/173 |
| 3,560,914 | 2/1971 | Webb | 367/157 |
| 3,740,706 | 6/1973 | Joseph | 367/173 |
| 3,802,377 | 4/1974 | Porter | 440/72 |
| 3,880,106 | 4/1975 | Farmer | 367/165 |
| 4,110,727 | 8/1978 | Kriege | 367/157 |
| 4,152,690 | 5/1979 | Veatch | 367/173 |

OTHER PUBLICATIONS

Hummingbird Waterproof Depth Sounder Operation Manual Techsonic Industries, Inc., One Hummingbird Lane, Lake Eufaula, AL, 36021, pp. 12 and 38–Trolling Motor Mounting Procedure.

*Primary Examiner*—Charles T. Jordan
*Assistant Examiner*—Brian S. Steinberger
*Attorney, Agent, or Firm*—Harold H. Dutton, Jr.

[57] ABSTRACT

An assembly is provided for mounting a sonar depth sounder transducer on an electric trolling motor such that the transducer is protected from entaglement with vegetation and from being knocked out of a predetermined orientation relative to the boat. The conventional bearing cap connected to the nose of a trolling motor is replaced by a bearing cap having a sonar tranducer integrally mounted therein such that the power cable, extending from the depth sounder in the boat to the transducer, is routed through the inside of the trolling motor housing and through the hollow tubular trolling motor support shaft. A power cable guide is mounted inside the trolling motor housing and is supported by a guide ring for positioning the power cable along a path preventing engagement with the armature, rotor and other moving parts in the trolling motor.

3 Claims, 2 Drawing Sheets

TROLLING MOTOR WITH SONAR TRANSDUCER

CROSS-REFERENCE TO RELATED APPLICATION

This is a continuation-in-part of my co-pending application for Design patent Ser. No. 613,816 filed May 25, 1984, entitled "FISH FINDER TRANSDUCER", now U.S. Pat. No. Des. 289,019.

BACKGROUND OF INVENTION

1. Field of the Invention

This invention relates to improvements in mounting assemblies for a sonar depth sounder transducer of the type used to measure water depth or to detect submerged objects such as fish, trees and river channels. The mounting assembly is connectable to a trolling motor.

2. Description of Prior Art

Fishermen and boaters use electronic sonar depth sounder systems extensively. These electronic sonar systems transmit and receive acoustical signals and display data on monitors located in the boat.

Fishermen use electric trolling motors attached to a boat to move a boat slowly through shallow water often laden with vegetation. Trolling motor transducers are commercially available and designed to be mounted on the outside of and below a trolling motor by an adjustable clamp. The trolling motor transducer is intended to provide an indication of the depth of the water below the electric trolling motor. Trolling motor transducers are commercially available from Techsonic Industries, Inc., One Hummingbird Lane, P. O. Box 261, Eufaula, Ala.

U.S. Pat. No. 3,880,106 discloses an adjustable band adapted to be secured about the outside of a trolling motor housing to mount a transducer on the outside of the nose of a trolling motor housing. U.S. Pat. No. 4,152,690 discloses a pivotal mechanism secured to the support shaft of a trolling motor for holding a transducer support mount vertically above the trolling motor. The pivotal mechanism is connected through a flexible control cable to a controlling device located in the boat.

Trolling motor mounting brackets attached to the outside of the trolling motor and protruding therefrom are vulnerable to entanglement with vegetation and susceptible to damage from submerged trees, rocks and the bottom of the body of water. The alignment and orientation of the transducer relative to the boat may be disturbed if contacted by vegetation resulting in inaccurate depth indications. Moreover, the power cable extending from the exposed transducer to the depth sounder is susceptible to being damaged by limbs and fishing lines.

Devices heretofore developed have not provided a totalling satisfactory method of attaching a transducer to a trolling motor such that the transducer and power cables are protected from damage.

SUMMARY OF INVENTION

An assembly is provided for mounting a sonar depth sounder transducer on an electric trolling motor such that the transducer is protected from entanglement with vegetation and from being knocked out of a predetermined orientation relative to the boat. The conventional bearing cap connected to the nose of a trolling motor is replaced by a bearing cap having a sonar transducer integrally mounted therein such that the power cable, extending from the depth sounder in the boat to the transducer, is routed through the inside of the trolling motor housing and through the hollow tubular trolling motor support shaft. A power cable guide is mounted inside the trolling motor housing and is supported by a guide ring for positioning the power cable along a path preventing engagement with the armature, rotor and other moving parts in the trolling motor.

The transducer, firmly mounted in the bearing cap secured to the trolling motor, is protected from damage while in use since the transducer is completely concealed and embedded in the bearing cap. The shielded power cable likewise is enclosed in the motor housing and the trolling motor support shaft such that it is protected from damage by objects in the water.

DESCRIPTION OF THE DRAWING

The accompanying drawings illustrating the invention are provided so that the invention may be better and more fully understood, in which.

Numeral references are employed to designate like parts throughout the various figures of the drawing.

DESCRIPTION OF A PREFERRED EMBODIMENT

Figure 6:
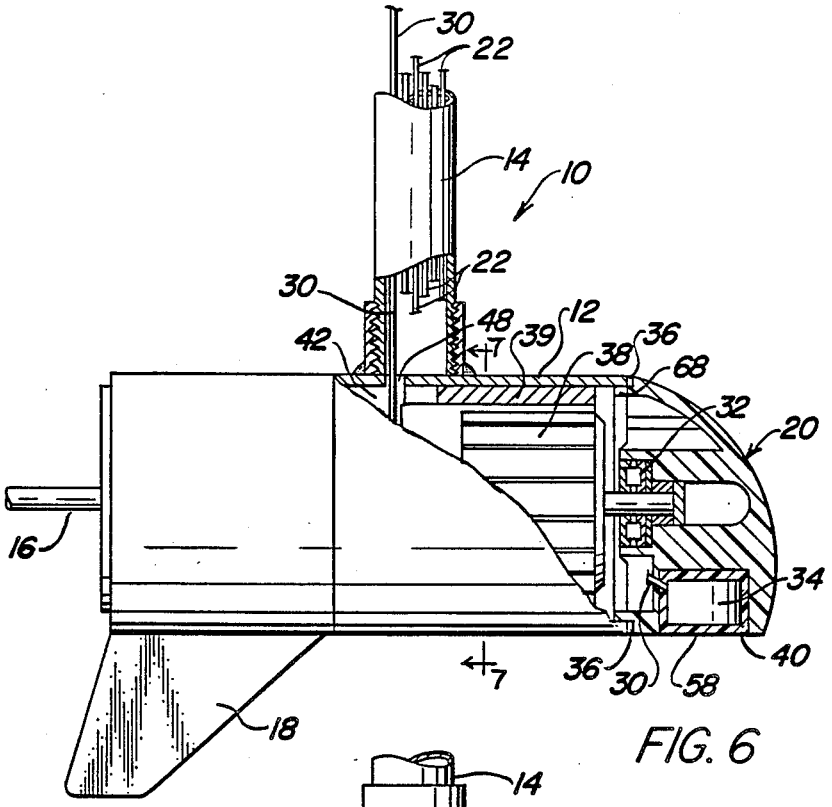
FIG. 6 is a side elevational view of a trolling motor having the bearing cap mounted thereon, parts being broken away to more clearly illustrate details of construction.

Referring to FIG. 6 of the drawing, the numeral 10 generally designates a conventional trolling motor assembly which has been modified by replacing the conventional bearing cap secured to the front end of motor housing 12 with a bearing cap 20 having a sonar transducer 34 mounted therein as will be hereinafter more fully explained.

A propeller drive shaft 16, extending from the rear end of motor housing 12, is connectable to a propeller, not shown, driven by the motor encased in the housing 12. Motor housing 12 is secured to the lower end of a hollow tubular control shaft 14 which is rotatably secured in a sleeve (not shown) hingedly secured to the boat in conventional manner. A tiller handle and electrical control switches (not shown) are mounted either on the upper end of control shaft 14 or at a remote location in the boat in conventional manner.

The directional orientation of motor 12 and the propeller is controlled by rotating shaft 14 about a substantially vertical axis. A fin 18 on the lower side of the rear end of motor housing 12 aids in guiding and steering the boat upon which the trolling motor 10 is mounted. Control shaft 14 generally extends through a sleeve and the vertical elevation of motor housing 12 is adjusted by a stop collar movably secured to control shaft 14. Trolling motors of the general type illustrated in the drawing are well known to persons skilled in the art and further description thereof is not deemed necessary, except with regard to changes which have been made in the structure for accomplishing the objects of the invention.

Bearing cap 20, which is connectable to the front end of motor housing 12, is best illustrated in FIGS. 1–5 of the drawing.

As best illustrated in FIGS. 1–4, the bearing cap generally designated by numeral 20 has transducer 34 encapsulated in a waterproof control head 40.

A shielded cable 30 extends from transducer 34 through motor housing 12 between the armature assembly 38 and field winding 39 of the motor.

Figure 7:
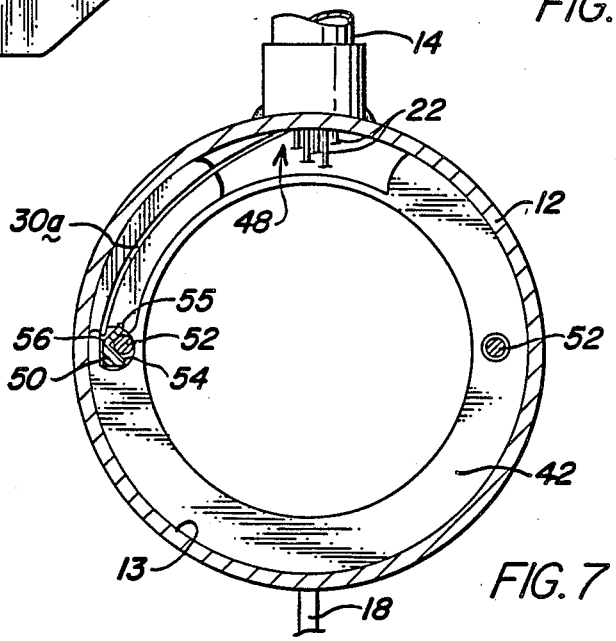
FIG. 7 is a cross-sectional view taken along line 7—7 of FIG. 6.

As best illustrated in FIG. 7, through bolts 52 extend longitudinally of motor housing 12 for securing housing segments together and extend into threaded apertures 51 formed in shoulders 49 in bearing cap 20.

A cable guide 50 having a groove 54 extending longitudinally along the length thereof is supported by one of the through bolts 52. Cable guide 50 has a lip 55 projecting outwardly therefrom and inclined relative to the inner wall 13 of bearing housing 12 to form a cradle 56 through which shielded cable 30 extends to assure that cable 30 is maintained out of engagement with armature assembly 38.

A cable guide ring 42 has spaced openings formed therein and is maintained in position, as illustrated in FIG. 6 of the drawing, adjacent the opening 48 in motor housing 12 through which motor control lines 22 conventionally extend. Guide ring 42 has an opening 44 mounted therein through which an end of guide member 50 and through bolt 52 extend. A circumferentially extending groove 45 is formed in ring 42 and extends from opening 44 in ring 42 to a position adjacent opening 48 in motor housing 12. Guide member 50 and shoulder 43 on guide ring 42 adjacent groove 45 route a central portion of cable 30 from transducer 34 through the motor housing 12 into the hollow support shaft 14. It should be appreciated that guide ring 42 is configured to assure that the portion **30*a* of shielded cable 30 which extends from cable guide member 50 to the motor support shaft 14** does not contact any moving parts of the motor.

Shielded cable 30 extends upwardly through support shaft 14 and may be provided with suitable connectors (not shown) to provide an electrical connection from transducer 34 through shielded cable 30 to any suitable sonar depth finder equipment at any convenient location.

Figure 1:
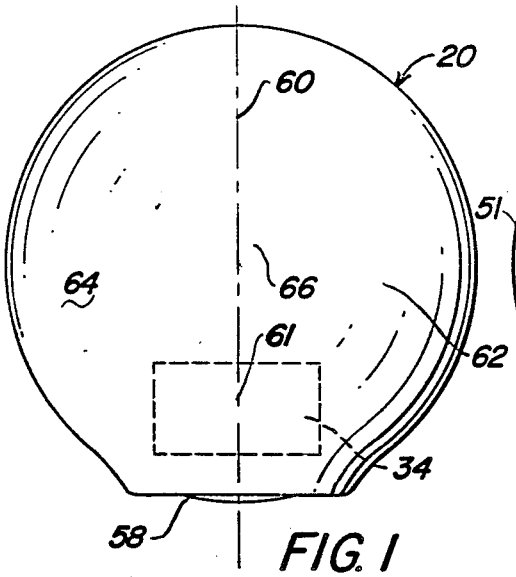
FIG. 1 is a front elevational view of a trolling motor bearing cap having a sonar transducer mounted therein.
Figure 2:
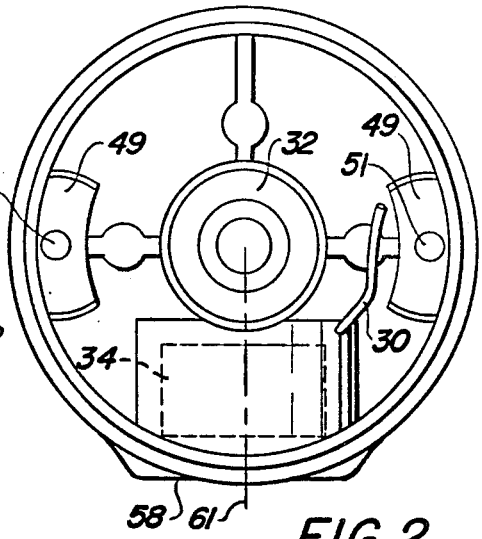
FIG. 2 is a rear elevational view thereof.
Figure 3:
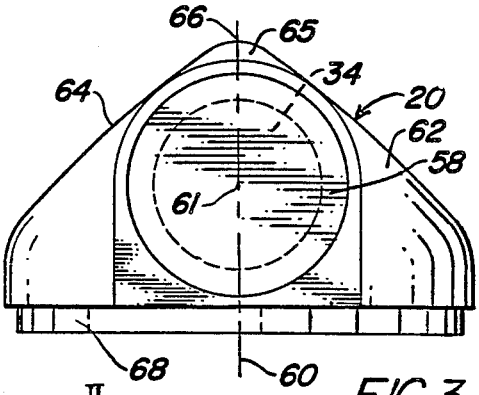
FIG. 3 is a bottom plan view thereof.
Figure 4:
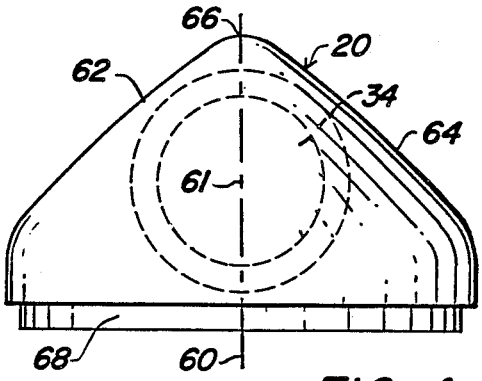
FIG. 4 is a top plan view thereof.

As best illustrated in FIGS. 1 and 3, the right side 62 and left side 64 of bearing cap 20 are symmetrical about a central plane 60 and transducer 34 has a central axis 61 lying in plane 60 and parallel to the axis of support shaft 14. Bearing cap 20 has a outwardly projecting tip 66 joining the right side surface 62 and the left side surface 64 to provide a wedge-like streamlined contour to minimize drag as bearing cap 20 moves through the water.

The lower portion 65 of tip 66 on bearing cap 20 is inclined rearwardly toward axis 61 to assure that water flow across flat bottom 58 of control head 40 is laminar to prevent the formation of air bubbles and to prevent collection of debris which might interfere with the transmission and reception of sonar waves by transducer 34.

Figure 5:
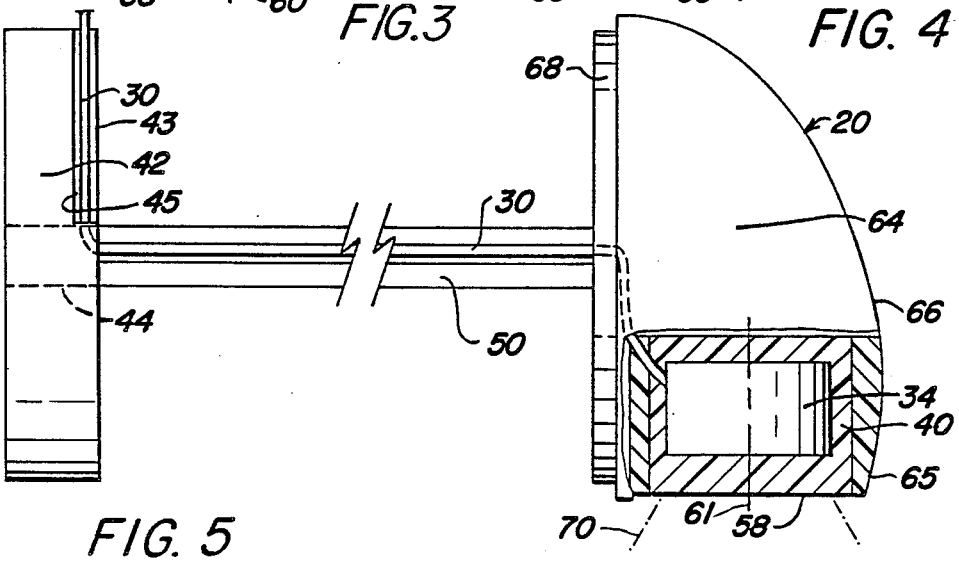
FIG. 5 is a left side elevational view of the bearing cap, cable guide and guide ring.

As best illustrated in FIGS. 5, 6 and 7, a lip 68 is formed on bearing cap 20 and extends into the cylindrical end of motor housing 12. A suitable seal, such as gasket 36, is mounted between bearing cap 20 and motor housing 12 to prevent leakage of water into the housing.

Thrust bearing 32 and annular lip 68 on bearing cap 20 are preferably positioned to replace corresponding parts of a conventional bearing cap of a trolling motor which is not equipped with transducer 34 such that the bearing cap carrying transducer 34 is interchangeable with conventional bearing caps heretofore employed on a trolling motor.

From the foregoing it should be readily apparent that the assembly illustrated in FIG. 5 of the drawing incorporates a sonar transducer 34 which can be mounted on an electric trolling motor assembly 10 such that transducer 34 is protected from entanglement with vegetation and is positioned such that it cannot be knocked out of a predetermined orientation relative to the trolling motor housing. The conventional bearing cap which has been heretofore connected to the nose of the trolling motor has been replaced by a bearing cap 20 having sonar transducer 34 integrally mounted therein such that the shielded power cable 30 extending from the depth sounder (not shown) in the boat to the transducer 34 is routed through the inside of the trolling motor housing 12 and through the hollow tubular trolling motor support shaft 14. Cable guide 50 is mounted inside trolling motor housing 12 and is supported by guide ring 42 for positioning shielded cable 30 along a path preventing engagement with armature assembly 38 and other moving parts of the trolling motor.

Transducer 34 is protected from damage while in use since the transducer is completely concealed and embedded in the bearing cap 20. The shielded power cable 30, completely enclosed in the motor housing 12 and trolling motor support shaft 14, is protected from damage by objects in the water.

Having described my invention, I claim:

1. A motor for propelling a boat comprising: an electric propulsion motor and a substantially cylindrical motor housing therefor and having an opening formed in one end of said housing; a support shaft supporting said motor housing; a bearing cap including a thrust bearing therein secured to said housing and closing said opening; said bearing cap further including a receptacle therein and a sonar transducer secured in said receptacle; said bearing cap having a cylindrical lip formed on the periphery thereof and extending into said opening in said housing, a power cable operably connected to said transducer and extending through said opening in said motor housing to said support shaft; through bolts extending from said motor housing and threadedly secured to said bearing cap; cable guide means supported by one of said bolts and being adapted to maintain a central portion of said power cable adjacent said one of said through bolts.

2. An electric trolling motor bearing cap for integrally mounting and protecting from damage while in use a sonar transducer therein comprising: a body portion having a recess integrally formed internally therein; a cylindrical lip protruding from said body portion; a sonar transducer; means securing said transducer in said integral recess; a power cable secured to said transducer and extending internally through said bearing; threaded aperatures adapted to receive bearing cap securing bolts and a thrust bearing secured to said body portion, said cylindrical lip being so configured as to sealingly engage a trolling motor housing to position said thrust bearing and support a trolling motor drive shaft therein.

3. An integral transducer mounting for an electric trolling motor having an armature and field coil mounted to operate a propeller driven shaft extending through a motor housing which is suspended from a hollow support shaft, the improvement comprising: a cap; a sonar transducer having a power cable; means securing said sonar transducer in said cap; means to secure said cap to the motor housing; cable guide means adapted to be installed in the motor housing to maintain said power cable spaced from the armature of the motor; and a cable guide ring adapted to be installed in the motor housing to route said power cable from the inside of the motor housing into the hollow support shaft.

* * * * *